US005461884A

United States Patent [19]

Depoe et al.

[11] Patent Number: 5,461,884

[45] Date of Patent: Oct. 31, 1995

[54] WARP-KNITTED TEXTILE FABRIC SHOE LINER AND METHOD OF PRODUCING SAME

[75] Inventors: Phillip D. McCartney, Oak Ridge; Sheila W. Voshell, Pleasant Garden, both of N.C.

[73] Assignee: Guilford Mills, Inc., Greensboro, N.C.

[21] Appl. No.: 183,657

[22] Filed: Jan. 19, 1994

[51] Int. Cl.[6] ..... D04B 21/00; A43B 13/38

[52] U.S. Cl. ..... 66/170; 36/43; 36/55; 66/195; 427/412

[58] Field of Search ..... 66/194, 195, 196, 66/170; 36/43, 44, 55; 252/49.6; 427/412

[56] References Cited

U.S. PATENT DOCUMENTS

| | | | |
|---|---|---|---|
| 3,020,169 | 2/1962 | Phillips, Jr. et al. | 36/55 X |
| 3,349,575 | 10/1967 | Schwartz | 66/194 X |
| 4,015,451 | 4/1977 | Gajjar | 66/195 |
| 4,062,131 | 12/1977 | Hsiung | 36/44 |
| 4,241,124 | 12/1980 | Kremer et al. | 36/43 X |
| 4,533,351 | 8/1985 | Washkuhn | 36/43 X |
| 5,099,588 | 3/1992 | Scholl | 36/55 |
| 5,259,126 | 11/1993 | Rosen | 36/93 |

FOREIGN PATENT DOCUMENTS

| | | | |
|---|---|---|---|
| 1707106 | 1/1992 | U.S.S.R. | 66/195 |

OTHER PUBLICATIONS

J. B. Lancashire, Tricot Openwork, The Knitter, vol. 29 No. 12, Dec. 1965, pp. 25–27.

A. Reisfeld, Warp Knit Fabrics and Products, Knitting Times, vol. 40 No. 8, Feb. 23, 1971, pp. 38–48.

*Primary Examiner*—John J. Calvert

*Attorney, Agent, or Firm*—Shefte, Pinckney & Sawyer

[57] ABSTRACT

A warp-knitted shoe liner fabric of a three-bar construction having a three-dimensional compressible character in the fabric's thickness dimension with a pattern of elongated coursewise underlaps at the fabric's technical back which, in use, is to be oriented to face inwardly of the interior foot-receiving area of the shoe. The fabric is preferably finished with dye bath-carrying anti-microbial/anti-fungal and wicking enhancement agents, and also has silicone and acrylic polymers applied to resist fraying and abrasion and improve the fabric softness.

20 Claims, 1 Drawing Sheet

WARP-KNITTED TEXTILE FABRIC SHOE LINER AND METHOD OF PRODUCING SAME

BACKGROUND OF THE INVENTION

The present invention relates generally to lining materials for shoes, specifically shoe uppers, and relates more particularly to a novel warp-knitted textile fabric especially suitable for use as a shoe liner and a method for fabricating such shoe liner fabric.

In the manufacture of shoes, it is common practice to line not only the sole but also the upper of the shoe with a suitably soft material to enhance the comfort of the shoes when worn. Various materials have been utilized for this purpose. A soft tanned leather material is often used in finer grades of shoes but is too expensive to justify its use in more economical grades of shoes in which it has become common practice to use some form of textile fabric material including, for example, warp-knitted tricot fabric. See, for example, U.S. Pat. Nos. 5,099,588 and 5,259,126.

SUMMARY OF THE INVENTION

It is an object of the present invention to provide an improved warp-knitted shoe liner fabric as well as a method of producing the same, which provides a relatively soft luxurious feel, yet is economical to manufacture.

Briefly summarized, the warp-knitted shoe liner fabric of the present invention is basically of an at least three-bar construction having at least three sets of yarns knitted together in needle loops arranged in longitudinally-extending wales and transversely extending courses in respective stitch patterns producing a compressible thickness to the fabric and having a pattern of elongated coursewise underlaps at the technical back of the fabric to provide a relatively soft feel to the surface thereof. This liner fabric may be utilized as a covering for the inwardly facing surface of all or a part of the upper of a shoe, with the technical back of the fabric being oriented to face inwardly of the interior foot-receiving area of the shoe to be in contact with the wearer's foot.

Preferably, one set of the warp yarns of the fabric is knitted in needle loops in every wale of every course, while the other two sets of warp yarns are knitted in needle loops in spaced wales of every course, preferably in alternating wales with the two sets of yarns formed in mirror image stitch patterns. The stitch construction of the fabric serves to form the elongated coursewise underlaps from the one set of yarns.

In a preferred embodiment, the one set of yarns are multifilament polyester yarns, each comprised of at least about 90 filaments, having a total denier of at least about 150, and warp-knitted in a 1-0, 3-4 stitch pattern, while the other two sets of yarns are multifilament polyester yarns having a total denier of no greater than about one-half the denier of the yarns of the one set and are warp-knitted in respective stitch patterns of 1-0 ,1-2 ,2-3,2-1 and 2-3,2-1,1-0,1-2.

In accordance with the method of the present invention, the fabric liner is produced by initially warp knitting a textile fabric of the aforedescribed three-bar construction and thereafter applying to the fabric softening, abrasion resistant, fraying resistant, mildew, and bacteria resistant, and wicking enhancement agents.

The fabric is preferably dyed, with the mildew and bacteria resistant agent and the wicking enhancement agent being applied during the dyeing step as part of a common dyeing and treatment bath. Calendaring, heat transfer printing, or another means of heating and compressing the fabric can serve to enhance the soft feel of the fabric.

DESCRIPTION OF THE PREFERRED EMBODIMENT

Figure 1:
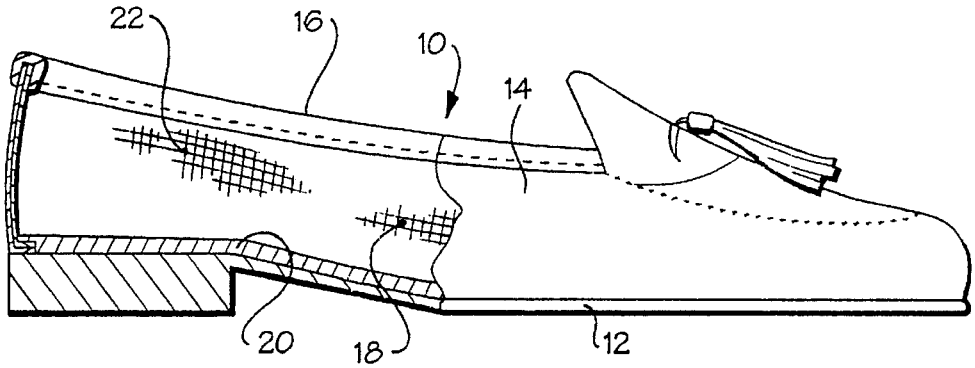
FIG. 1 is a side elevational view, partially in vertical cross-section, of a shoe having a warp-knitted fabric liner in accordance with the preferred embodiment of the present invention.

Referring now to the accompanying drawings and initially to FIG. 1, a representative shoe of the type in which the warp-knitted fabric liner of the present invention may preferably be embodied is shown generally at 10. However, while the fabric liner of the present invention is herein described and illustrated as embodied in a slipper-style casual-wear shoe, it is to be understood that, as used herein, the term shoe is intended to encompass any form of footwear, whether of the dress, casual, athletic, or other variety, in which a fabric liner for the shoes' upper may advantageously be utilized, including by way of example, but without limitation, boots.

Basically, the shoe 10 of FIG. 1 is of an essentially conventional construction which therefore need not be described in detail. The shoe 10 basically includes an outsole 12 to which an upper 14 is affixed adhesively and/or by stitching to define an opening 16 into an interior foot-receiving area 18. Within the foot-receiving area 18, an insole 20, normally including cushioning material, covers the inwardly facing foot contacting surface of the outsole 12 and the warp-knitted liner fabric 22 covers all or at least a portion of the inwardly-facing surface of the upper 14.

Figure 2:
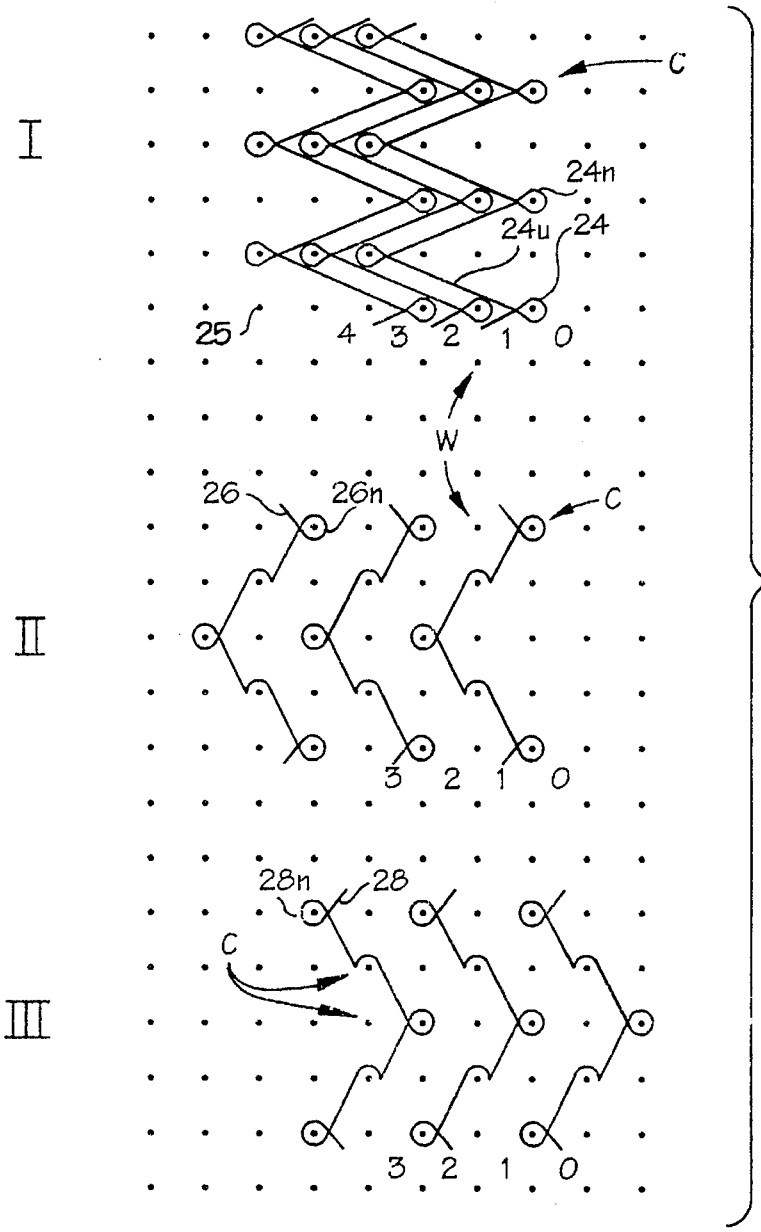
FIG. 2 is a schematic diagram showing individually the stitch pattern for the three sets of warp yarns as carried out by a warp knitting machine in knitting the preferred embodiment of the fabric liner of the present invention.

FIG. 2 depicts one particular preferred embodiment of the present shoe liner fabric 22 as preferably warp-knitted of a three-bar construction on a three-bar warp knitting machine. The warp knitting machine may be of any conventional type of an at least three-bar construction having three or more yarn guide bars and a needle bar, e.g., a conventional tricot warp knitting machine. The construction and operation of such machines are well-known in the warp knitting art and need not herein be specifically described and illustrated.

In the following description, the yarn guide bars of the knitting machines are identified as "top", "middle", and "bottom", guide bars for reference purposes only and not by way of limitation. As those persons skilled in the art will understand, such terms equally identify knitting machines whose guide bars may be referred to as "front", "middle", and "back" guide bars, which machines and the fabrics produced thereon of course are not to be excluded from the scope and substance of the present invention. As further used herein, the "bar construction" of a warp knitting machine refers to the number of yarn guide bars of the machine, while the "bar construction" of a warp-knitted fabric refers to the number of different sets of warp yarns included in the fabric, all as is conventional terminology in the art.

As is conventional, the needle bar of the warp knitting machine carries a series of aligned knitting needles, while each guide bar of the machine carries a series of guide eyes, the needle and guide bars of the machine preferably having the same gauge, i.e., the same number of needles and guide eyes per inch. According to the embodiment of the present fabric illustrated in FIG. 2, the bottom yarn guide bar of the machine is threaded on every guide eye with a first set of yarns 24 delivered from a warp beam (not shown), while the middle and top guide bars are threaded on alternating guide eyes with second and third sets of yarns 26,28, respectively, delivered from a common warp beam (also not shown), whereby each of the middle and top guide bars control the manipulation of one-half the total number of yarns guided and controlled by the bottom guide bar. As more fully explained hereinafter, the threading arrangement of the three guide bars is set up in conjunction with the stitch patterns of the three sets of yarns to deliver the first set of yarns 24 to every needle of the needle bar during the formation of every fabric course while delivering the other two sets of yarns 26,28 to every alternate needle of the needle bar during the formation of each fabric course.

While it is contemplated that a variety of yarns may be suitable for use in knitting the liner fabric 22, it is preferred that the yarns be relatively inelastic so as to contribute, in conjunction with the fabric stitch construction, to the dimensional stability of the fabric and it is further preferred that the yarns be multifilament synthetic yarns, particularly polyester yarns, to lend a desirable softness and comfortable feel to the fabric. The denier of the yarns may vary depending upon the desired weight of the fabric per unit fabric dimension. For the intended application of the fabric 22 as a shoe liner, it is contemplated to be preferable that each yarn of the first sets of yarn 24 have a total denier of at least about 150 comprised of at least about 90 individual filaments, while the other two sets of yarns 26,28 should have a total denier of no greater than about one-half the denier of the yarns 24. For example, in the illustrated embodiment, the yarns 24 preferably are a 168 denier, 100 filament, semi-dull polyester having an octalobal cross-sectional shape, while each of the yarns 26,28 is a 70 denier, 34 filament polyester yarn having a dull surface luster.

In FIG. 2, the stitch constructions of the yarns 24,26,28, as carried out by the respective lateral traversing movement of the guide bars of the knitting machines in producing the preferred embodiment of the present liner fabric, are illustrated individually in a traditional dot or point diagram format, wherein the individual points 25 represent the needles of the needle bar of the knitting machine in the formation of several successive fabric courses C across several successive fabric wales W. According to this embodiment, the bottom guide bar of the warp knitting machine manipulates the first set of yarns 24 as they are fed from their respective warp beam to traverse laterally back and forth relative to the needle bar of the machine to stitch the yarns 24 on every needle 25 in a repeating 1-0,3-4 stitch pattern, as indicated at I of FIG. 2. Simultaneously, the middle and top guide bars of the knitting machine respectively manipulate the second and third sets of yarns 26,28 to traverse relative to the needle bar to stitch the yarns 26,28 on alternating needles 25A in repeating stitch patterns which are mirror images of one another, the middle bar yarns 26 following a 1-0,1-2,2-3,2-1 stitch pattern as indicated at II and the top bar yarns 28 following a 2-3,2-1,1-0,1-2 stitch pattern as indicated at III.

As will thus be understood, the yarns 24,26,28 are interknitted with one another by formation of needle loops **24*n* of the yarns 24 in every wale W of every course C while forming respective needle loops 26*n*,28*n* of the yarns 26,28 in alternating wales W of each course C. As those persons skilled in the art will recognize, the respective opposing mirror image stitch patterns of the yarns 26,28 provide structural integrity to the fabric, while the stitch pattern followed by the bottom bar yarns 24 produces elongated underlaps 24*u* across a two needle spacing between each succeeding needle loop 24*n* of each yarn 24, which underlaps 24*u*** appear collectively at the technical back of the fabric to provide a relatively soft, smooth, satin-like feel to the fabric's technical back.

Subsequent to the fabrication of the liner fabric 22, the present invention provides for finishing treatment of the fabric to provide or enhance its physical characteristics so as to perform optimally in the fabric's application as a shoe liner. Initially, the knitted fabric is subjected to a dyeing process by any conventional form of textile dyeing equipment, e.g., vat dyeing or jet dyeing equipment, normally carried out under elevated pressure in a pressurized dye vessel in order to impregnate the yarns with a suitable dyestuff to impart a desired color to the fabric. Added to the dye bath is an anti-microbial/anti-fungal agent to enhance the fabric's ability to resist gram-negative and gram-positive bacteria and mildew, as well as a bath-carried agent to treat the yarn surfaces of the fabric to impart to the normally hydrophobic synthetic polyester yarns the ability to wick moisture to release dirt and soil, and to dry more quickly than if the fabric were left untreated. Preferably, the anti-microbial/anti-fungal agent is an organotin or related compound exhibiting properties and capabilities of destroying or inhibiting growth of microorganisms, bacteria, and mildew, such as the DM50 organotin produced and sold by Thomson Research Associates of Ontario, Canada. The wicking enhancement agent is preferably a polyester polymer solution which is hydrophilic in nature and serves to impart a hydrophilic character to the fabric by coating thereon, such as the composition sold under the trade name NATURE by ICI, Inc. of Providence, R.I. Of course, as those persons skilled in the art will understand, other forms of anti-microbial/anti-fungal agents and other forms of wicking enhancement agents could also be used and, further, application of such compositions could be accomplished by any conventional means other than by addition to the dye bath for the fabric.

In addition, an acrylic polymer is applied by any conventional means of application to the fabric surface, but at least the technical back of the fabric, at a dry add-on rate of between approximately 3 percent and 10 percent of the weight of the fabric, to enhance the ability of the underlaps **24*u* of the yarns 24** at the fabric's technical back to resist fraying. For example, an acrylic latex solution, such as the latex solution sold by Parachem Southern of Simpsonville, S.C., under the trade name PARANOL Acrylic 774, is preferably applied to the fabric by a conventional padding operation. A non-oily polymeric silicone in an encapsulated form is also applied to the surface of the fabric by any suitable conventional means at a dry add-on rate also in the range of about 3 percent to about 10 percent of the weight of the fabric. A preferred silicone is the encapsulated silicone emulsion also sold by Parachem Southern under the trade name NOSTICK 843 or SDB06, which is preferably applied along with the acrylic latex solution as part of the same padding operation.

The silicone treatment performs two functions. First, it serves to maintain the relatively soft, smooth hand and feel of the fabric by negating any tendency of the acrylic material to detract from the fabric's surface softness. Secondly, the silicone enhances the fabric's ability to resist abrasion.

Importantly, since the silicone is encapsulated, i.e., contained within another suitable carrier material, the silicone is released for purposes of performing its abrasion resistant function only when abrading frictional forces are applied to the fabric surface to cause the silicone capsules to in effect burst. Thus, the presence of the encapsulated silicone on the fabric's surface does not act as a water repellent and therefore does not detract from the wickability imparted by the dye bath agent.

It is also contemplated to be desirable in some cases to finish the fabric by a calendaring operation and/or by a heat transfer printing of the fabric, e.g., to apply a repeating trademark to the technical back of the fabric to be visible within the shoe 10. The simultaneous heat and compression of the fabric accomplished by either of these finishing treatments serves to render the fabric surface particularly silky and smooth to the touch.

The present warp-knitted liner fabric 22, as knitted and subsequently finished in the manner described above, is incorporated into the shoe 10 during the fabrication thereof in the same manner as any other fabric shoe liner, e.g., by sewing or, if appropriate, by adhering the fabric to the inward surface of the shoe upper 14. Importantly, in accordance with the present invention, the technical back of the fabric 22 should face inwardly of the foot-receiving area of the shoe so as to present an optimal foot-contacting surface. The yarns 24 in the fabric 22, and particularly their underlaps *24u* appearing at the technical back, lend a three-dimensional compressibly resilient character to the fabric which, together with the relatively soft hand and feel of the surface of the fabric's technical back, provides a particularly comfortable feel to the wearer's foot.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a shoe having a sole and an upper affixed to the sole to define an interior foot-receiving area, a liner covering the inwardly facing surface of at least a portion of the upper, the liner comprising a warp-knitted textile fabric of at least three-bar construction having at least three sets of yarns knitted together in needle loops arranged in longitudinally extending wales and transversely extending courses in respective stitch patterns producing a compressible thickness to the fabric and having a pattern of elongated coursewise underlaps at the technical back of the fabric to provide a relatively soft feel to the surface thereof, the liner fabric being oriented with its technical back facing inwardly of the interior foot-receiving area of the shoe, wherein at least the technical back of the fabric comprises a first surface finish including a releasable silicone for resisting abrading forces on the fabric and a second surface finish comprising a hydrophilic coating on the yarns for wicking moisture from the technical back of the fabric.

2. A shoe having a warp-knitted fabric liner according to claim 1, wherein each yarn comprises a multifilament polyester yarn.

3. A shoe having a warp-knitted fabric liner according to claim 1, wherein one set of yarns is knitted in needle loops in every wale of every course and the other two sets of yarns are knitted in needle loops in spaced wales of every course.

4. A shoe having a warp-knitted fabric liner according to claim 3, wherein the one set of yarns forms the elongated coursewise underlaps.

5. A shoe having a warp-knitted fabric liner according to claim 4, wherein the other two sets of yarn are knitted in needle loops in alternate wales of every course.

6. A shoe having a warp-knitted fabric liner according to claim 5, wherein the other two sets of yarns are warp-knitted in respective stitch patterns which are mirror images of one another.

7. A shoe having a warp-knitted fabric liner according to claim 6 wherein the one set of yarns is warp-knitted in a 1-0,3-4 stitch pattern and the other two sets of yarns are warp-knitted in respective stitch patterns of 1-0,1-2,2-3,2-1 and 2-3,2-1,1-0,1-2.

8. A shoe having a warp-knitted fabric liner according to claim 7, wherein each yarn of the one set of yarns is a multifilament polyester yarn comprised of at least about 90 filaments having total denier of at least about 150.

9. A shoe having a warp-knitted fabric liner according to claim 8, wherein each yarn of the other two sets of yarns is a multifilament polyester yarn having a total denier of no greater than about one-half the denier of the yarns of the one set of yarns.

10. A shoe having a warp-knitted fabric liner according to claim 1, wherein the fabric contains a softening finish.

11. A shoe having a warp-knitted fabric liner according to claim 1, wherein the fabric contains a fraying resistant finish.

12. A shoe having a warp-knitted fabric liner according to claim 1, wherein the fabric contains a mildew and bacteria resistant finish.

13. A shoe having a warp-knitted fabric liner according to claim 1, wherein the first finish comprises capsules on the surfaces of the yarns at the technical back of the fabric containing the silicone encapsulated within a carrier material for release of the silicone in response to abrading forces sufficient to burst the capsules, whereby the silicone in the first finish does not impair the wicking effect of the second finish.

14. A shoe according to claim 1, wherein the hydrophilic coating of the second finish comprises a hydrophilic polymeric polyester.

15. A warp-knitted textile fabric for use as a shoe liner, the fabric being of at least three-bar construction having at least three sets of yarns knitted together in needle loops arranged in longitudinally extending wales and transversely extending courses in respective stitch patterns producing a compressible thickness to the fabric and having a pattern of elongated coursewise underlaps at the technical back of the fabric to provide a relatively soft feel to the surface thereof, the liner fabric being oriented with its technical back facing inwardly of the interior foot-receiving area of the shoe, wherein at least the technical back of the fabric comprises a first surface finish including a releasable silicone for resisting abrading forces on the fabric and a second surface finish comprising a hydrophilic coating on the yarns for wicking moisture from the technical back of the fabric.

16. A warp-knitted fabric according to claim 15, wherein the first finish comprises capsules on the surfaces of the yarns at the technical back of the fabric containing the silicone encapsulated within a carrier material for release of the silicone in response to abrading forces sufficient to burst the capsules, whereby the silicone in the first finish does not impair the wicking effect of the second finish.

17. A warp-knitted fabric according to claim 15, wherein the hydrophilic coating of the second finish comprises a hydrophilic polymeric polyester.

18. A textile fabric for use as a shoe liner, the fabric being of a construction of integrated yarns producing a compressible thickness to the fabric, wherein at least one side of the fabric comprises a first surface finish including a releasable silicone for resisting abrading forces on the fabric and a second surface finish comprising a hydrophilic coating on the yarns for wicking moisture from the one side of the fabric.

19. A fabric according to claim 18, wherein the first finish comprises capsules on the surfaces of the yarns of the fabric containing the silicone encapsulated within a carrier material for release of the silicone in response to abrading forces sufficient to burst the capsules, whereby the silicone in the first finish does not impair the wicking effect of the second finish.

20. A fabric according to claim 18, wherein the hydrophilic coating of the second finish comprises a hydrophilic polymeric polyester.

* * * * *